US006145995A

United States Patent [19]

Hung

[11] Patent Number: 6,145,995

[45] Date of Patent: Nov. 14, 2000

[54] PRECISION SCREWDRIVER

[76] Inventor: Kun-Chih Hung, No. 56, Shin Ren 3rd Street, Ta Li, Taichung Hsien, Taiwan

[21] Appl. No.: 09/325,721

[22] Filed: Jun. 4, 1999

[51] Int. Cl.[7] ..... B25B 23/18

[52] U.S. Cl. ..... 362/119; 362/120; 362/206; 362/578

[58] Field of Search ..... 362/119, 120, 362/109, 205, 202, 204, 206, 251, 578

[56] References Cited

U.S. PATENT DOCUMENTS

| | | | |
|---|---|---|---|
| 2,336,136 | 12/1943 | Thomson et al. | 362/120 |
| 5,713,656 | 2/1998 | Lin | 362/119 |
| 6,030,092 | 2/2000 | McCalla et al. | 362/119 |

*Primary Examiner*—Alan Cariaso
*Assistant Examiner*—David V. Hobden
*Attorney, Agent, or Firm*—Rosenberg, Klein & Lee

[57] ABSTRACT

A precision screwdriver includes a hollow grip and a bottom cap screwed with a bottom end of the grip. An end face of the bottom cap is disposed with a central switch and a conducting member. A rotary cover is rotatably disposed at the end face of the bottom cap. A cell is received in the grip. A light shade is installed in a non-circular socket of front end of the grip. A bulb is disposed in the light shade. An engaging seat of a transparent sleeve is engaged in the non-circular socket. The front end of the sleeve is formed with a tool connecting section for engaging with a screwdriver head. The switch is received in the rotary cover, so that a user can push the end face of the rotary cover at the end of the grip with fingers or palm so as to rotate the precision screwdriver. Via the switch, the user is able to control the on/off of the bulb in the grip so as to provide an illumination for the work.

8 Claims, 8 Drawing Sheets

PRECISION SCREWDRIVER

BACKGROUND OF THE INVENTION

The present invention relates to a precision screwdriver in which a switch is received in a rotary cover at the end of the grip for controlling the on/off of a bulb in the grip so as to provide an illumination for the work.

FIGS. 7 and 8 show an existing screwdriver having a grip 90 in which a light emitting device 91 is installed. A rear end of the light emitting device 91 is disposed with a switch 92 and a rear end of the grip 90 is disposed with a cap member 93 having a central resilient button 94. By means of depressing the resilient button 94, the switch of the light emitting device 91 can be switched on or off. The front end of the grip 90 is fixed with a transparent casing 95 by an outer cover 97. The front end of the casing 95 is disposed with a stem 96 equipped with a tool head 98. The light emitting device 91 serves to provide an illumination for working.

In use of a precision screwdriver, the end face of the rear end of the grip must be pushed by the user's fingers or palm so as to facilitate use of the precision screwdriver. Therefore, in the case that the above structure is applied to the precision screwdriver, the user may unintentionally touch the resilient button 94 and the cap member 93 cannot be rotated. This leads to inconvenience in use.

In addition, the transparent casing 95 is fixed with the grip 90 by the fastening force of the outer cover 97 and the grip 90. Therefore, when the user rotates the grip 90 with a greater torque, the transparent casing 95 will slide relative to the grip 90 and thus the application force exerted onto the grip 90 can be hardly accurately transmitted to the tool head 98 of the stem 96 for rotating a work piece.

SUMMARY OF THE INVENTION

It is therefore a primary object of the present invention to provide a precision screwdriver in which a switch is received in a rotary cover at the end of the grip, whereby a user can push the end face of the rotary cover with fingers or palm so as to rotate the precision screwdriver. The switch in the rotary cover serves to control the on/off of a bulb in the grip so as to fully provide an illumination for the work.

It is a further object of the present invention to provide the above precision screwdriver in which a non-circular section of an engaging seat of the sleeve is engaged in a non-circular socket of the grip, whereby the grip is firmly associated with the sleeve for effectively transmitting the power.

It is still a further object of the present invention to provide the above precision screwdriver in which the sleeve and the engaging seat are made of transparent plastic material, whereby the light emitted from the bulb can be reflected by the light shade and projected forward to provide a necessary illumination for the work.

According to the above objects, the precision screwdriver of the present invention includes:

- a hollow grip, one end of the grip being formed with an outer thread, the other end of the grip being formed with a non-circular socket, a cell being placed in the grip;
- a bottom cap an end face of which is disposed with a central switch and a conducting member, the bottom cap being formed with an inner thread for screwing with the outer thread of the grip, a rotary cover being rotatably disposed at the end of the bottom cap;
- a light shade in which a bulb is installed, the light shade being fitted into the non-circular socket of the grip; and
- a sleeve one end of which has a radially extending engaging seat 41 which has an axially extending non-circular section for fitting into the non-circular socket of the grip and connected therewith, an end face of the non-circular section abutting against the end face of the light shade, the other end of the sleeve being formed with a tool connecting section.

The present invention can be best understood through the following description and accompanying drawings wherein:

DETAILED DESCRIPTION OF THE PREFERRED EMBODIMENTS

Figure 1:
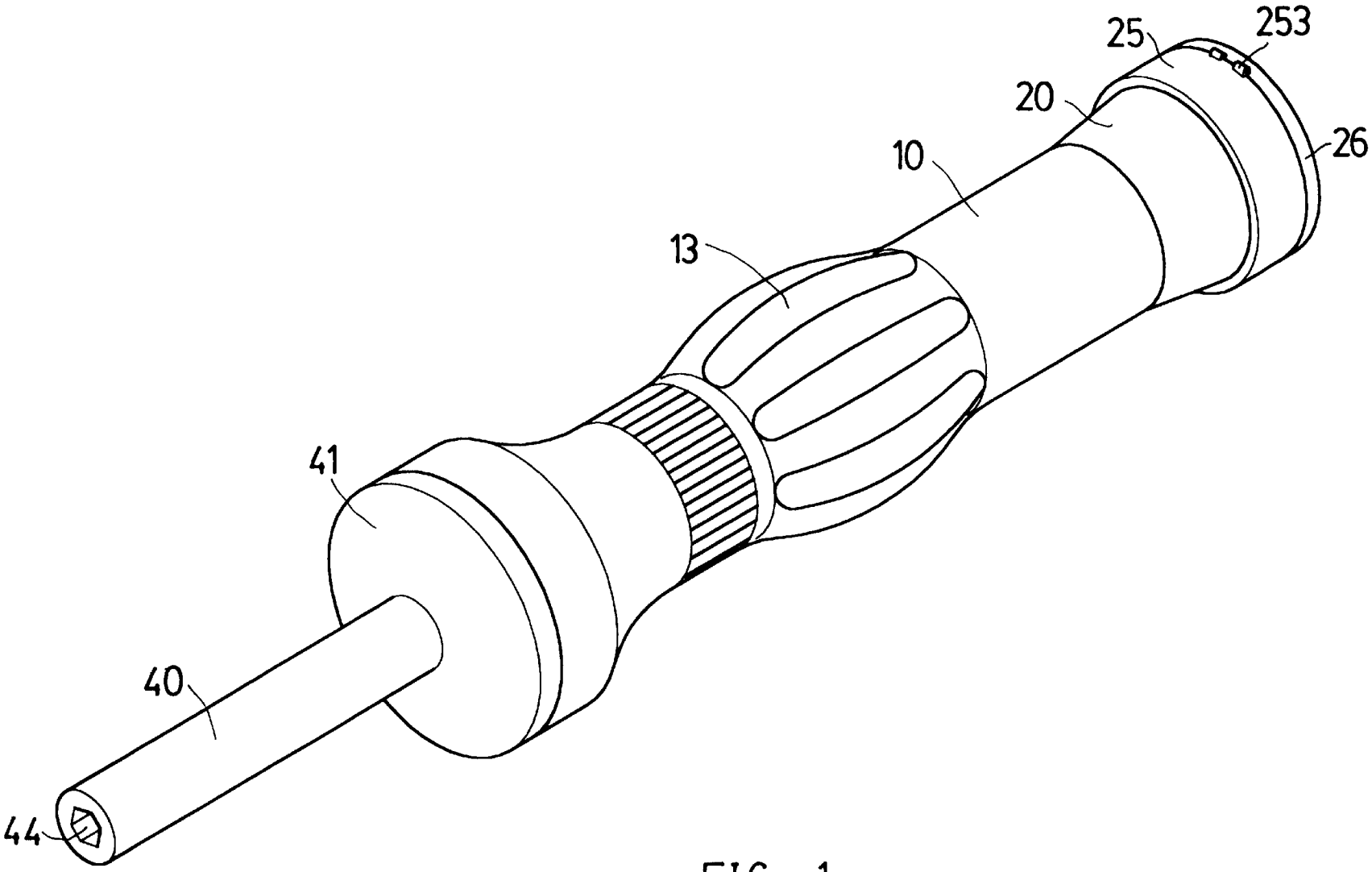
FIG. 1 is a perspective assembled view of the present invention.
Figure 2:
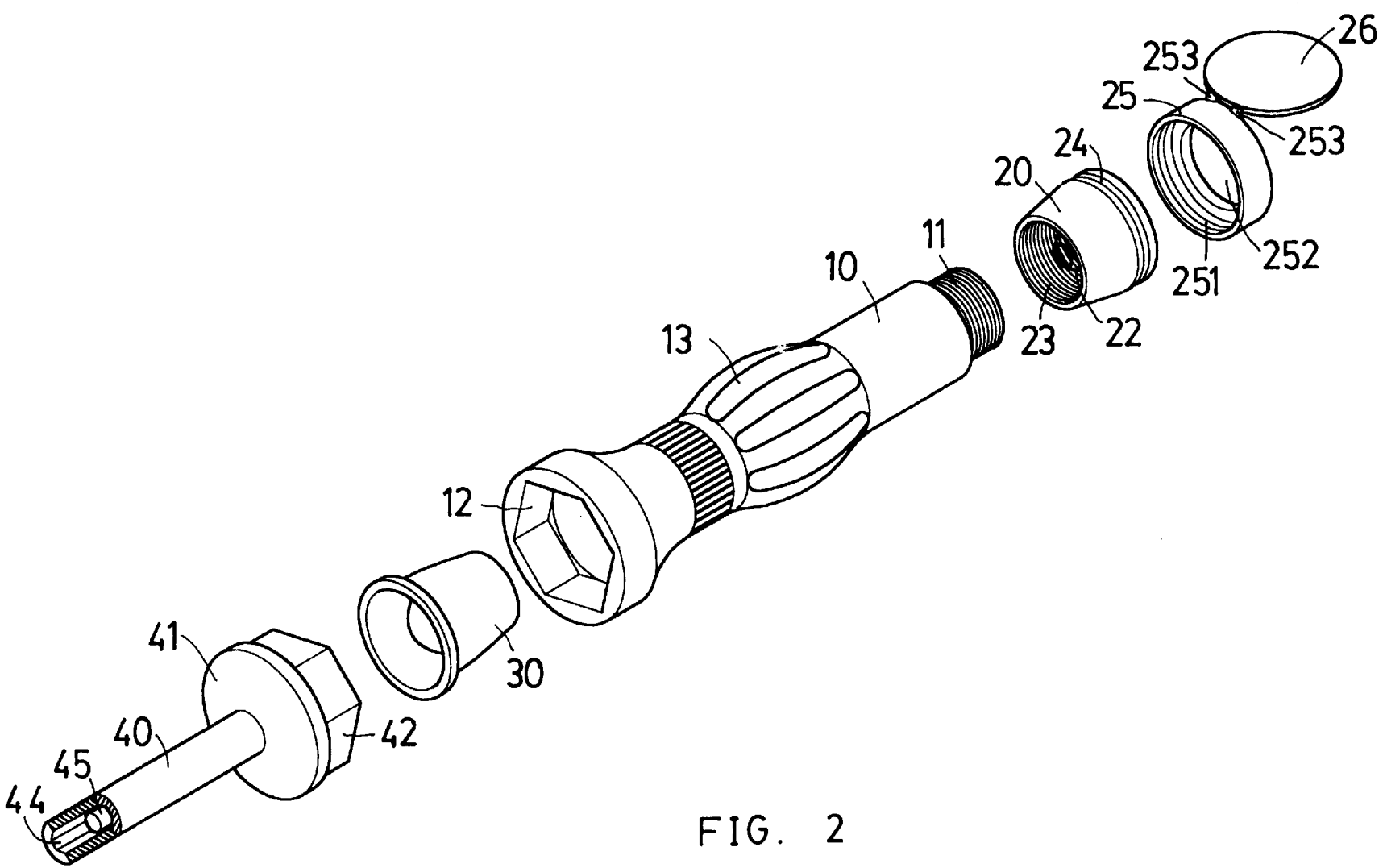
FIG. 2 is a perspective exploded view of the present invention.
Figure 3:
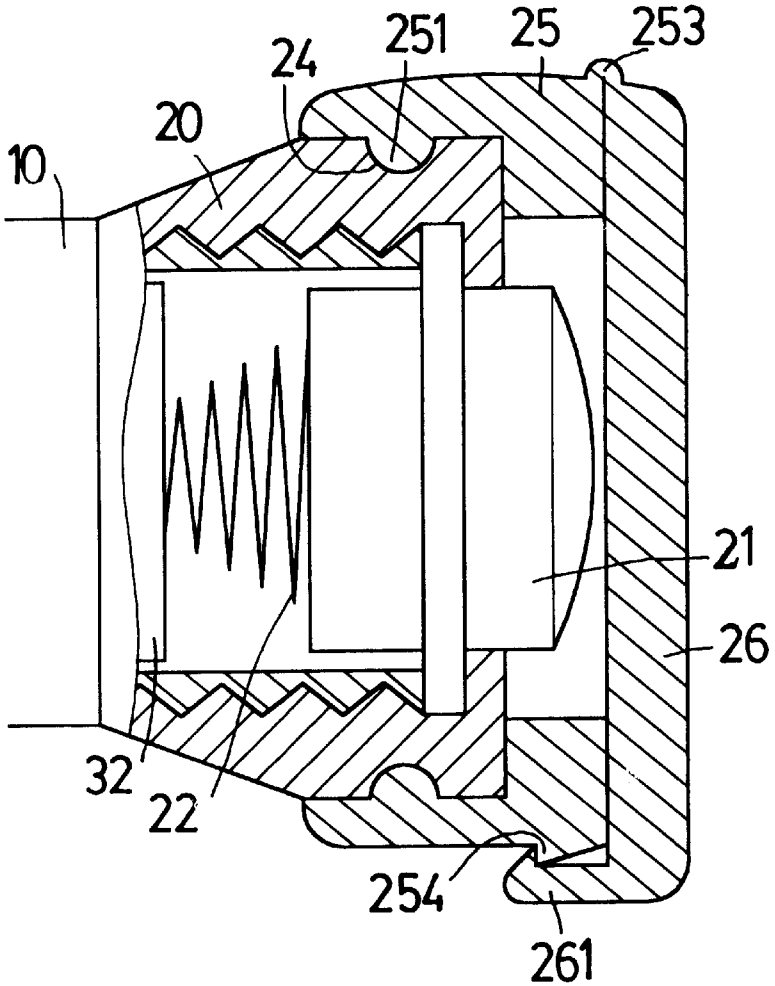
FIG. 3 is a sectional assembled view of the bottom cap, rotary cover and tail cover of the present invention.

Please refer to FIGS. 1 to 3. According to a first embodiment, the precision screwdriver of the present invention includes:

- a hollow grip 10, one end of the grip 10 being formed with an outer thread 11, the other end thereof being formed with a hexagonal socket 12, a No. 4 cell 32 (AAA cell) or a smaller No. 5 cell being placed in the grip 10, the outer circumference of the grip 10 being disposed with multiple slipproof channels 13;
- a bottom cap 20 an end face of which is disposed with a central switch 21 and a conducting member 22, the bottom cap 20 being formed with an inner thread 23 for screwing with the outer thread of the grip 10, an outer circumference of the bottom cap 20 being formed with an annular groove 24 in which a flange 251 of a rotary cover 25 is rotatably engaged, an end face of the rotary cover 25 being formed with a central through hole 252 in which the switch 21 is received, one side of the rotary cover 25 being connected with a tail cover 26 via a connecting section 253, whereby the tail cover 26 can be pivotally opened or closed onto the rotary cover 25, an outer circumference of the rotary cover 25 being formed witch a projection 254 radially opposite to the connecting section 253, the tail cover 26 being formed with an engaging hook 261 corresponding to the projection 254, whereby the engaging hook 261 can be engaged with the projection 254 so as to latch the tail cover 26 with the rotary cover 25;
- a light shade 30 in which a bulb 31 is installed, an outer diameter of the light shade 30 being slightly smaller than an inner diameter of an internal tangential circle of the hexagonal socket 12 of the grip 10, whereby the light shade 30 can be placed into the hexagonal socket 12 of the grip 10; and
- a transparent sleeve 40 one end of which has a radially extending engaging seat 41 which has an axially extending hexagonal section 42 for fitting into the hexagonal socket 12 of the grip 10 and fused therewith by ultrasonic wave, an end face of the hexagonal section 42 abutting against the end face of the light shade 30, the other end of the sleeve 40 being formed with an axially extending hexagonal socket 44, a magnet 45 being disposed at the bottom of the hexagonal socket 44 for fixing a screwdriver head 46 fitted into the hexagonal socket 44.

Figure 4:
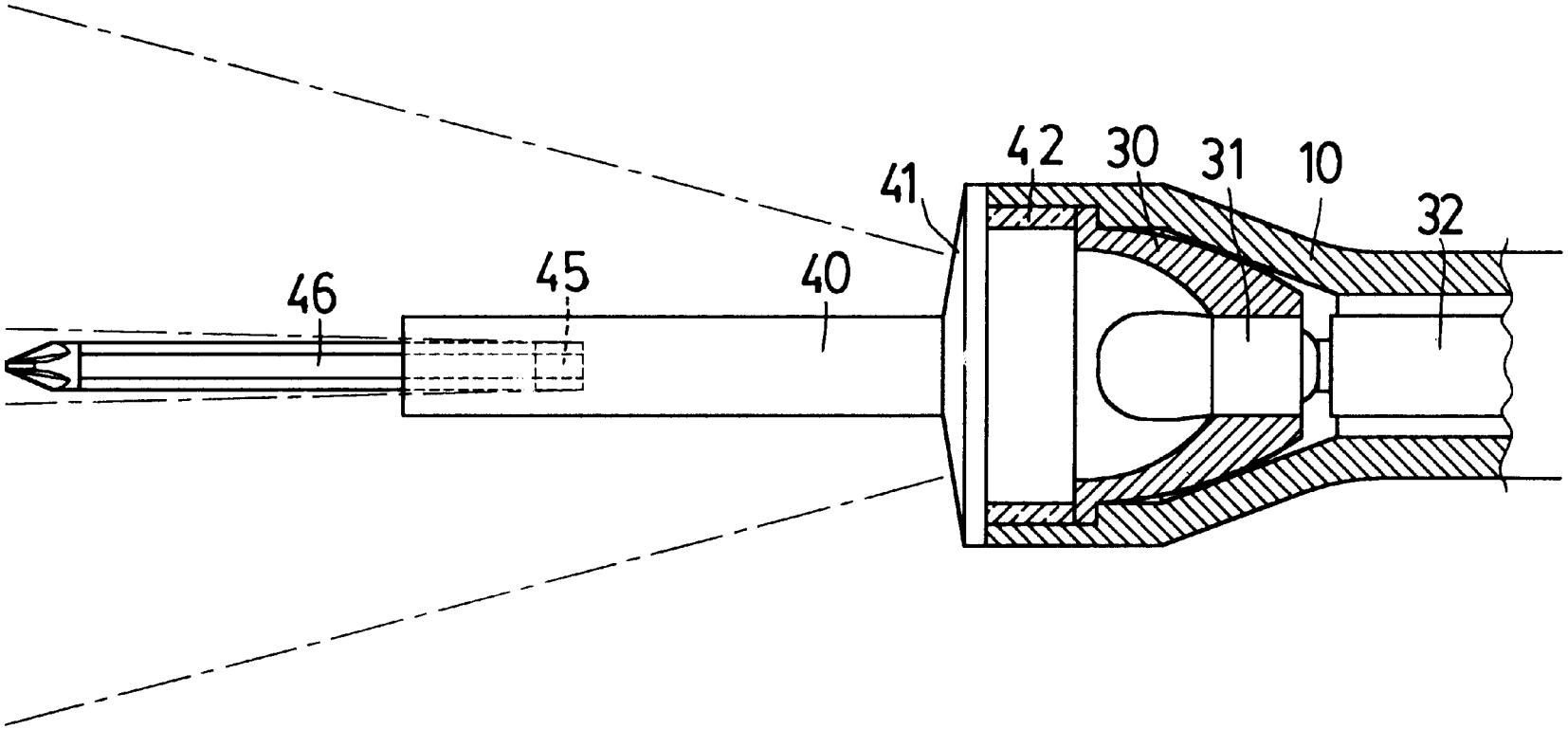
FIG. 4 shows the projection of the light of the present invention.

When requiring illumination, one side of the tail cover 26 with the engaging hook 261 is pushed open and disengaged from the projection 254. Then the tail cover 26 is pivotally opened, permitting a user to press the switch 21 of the bottom cap 20 through the through hole 252 of the rotary cover 25 and light up the bulb 31. The light is emitted from the bulb 31 and reflected by the light shade 30 to project forward. Referring to FIG. 4, the sleeve 40 is made of transparent plastic material so that the light can pass through the sleeve 40 and only the most forward magnet 45 and the screwdriver head 46 will shade a minor part of the light. Therefore, a sufficient illumination can be provided for the work.

The rotary cover 25 and the tail cover 26 at the end of the bottom cap 20 are freely rotatable. In use, a user's fingers or palm can push the rotary cover 25 and the tail cover 26 so as to facilitate the operation and rotation of the precision screwdriver.

The hexagonal section 42 of the engaging seat 41 of the sleeve 40 is fitted into the hexagonal socket 12 of the grip 10 and fused therewith by ultrasonic wave so that the sleeve 40 is firmly associated with the grip 10 face to face without relative slippage and thus the power can be effectively transmitted.

Figure 5:
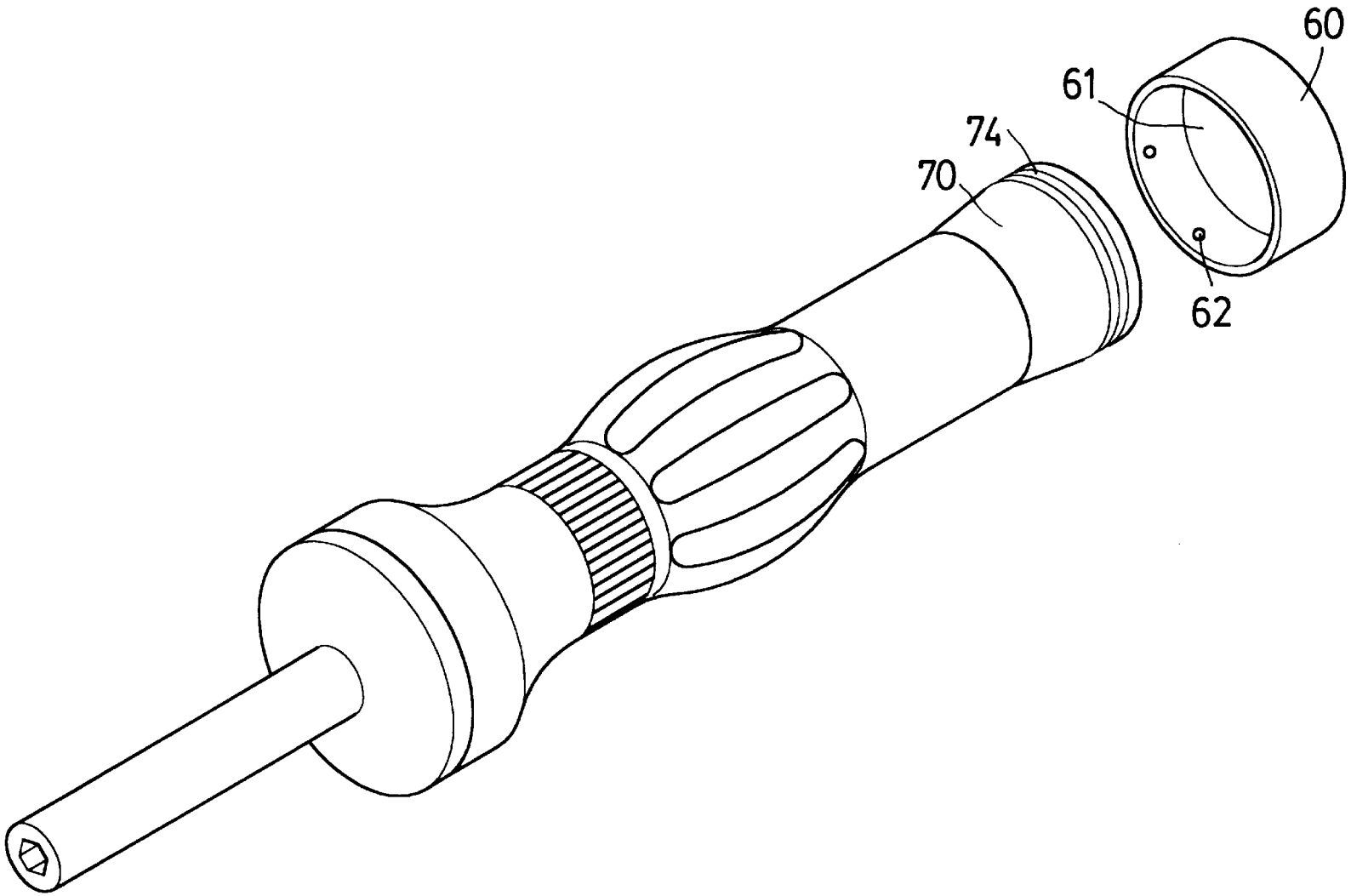
FIG. 5 is a perspective exploded view of a second embodiment of the present invention.

FIG. 5 shows a second embodiment of the present invention, in which the rotary cover 60 has a cavity 61. A peripheral wall of the cavity 61 is disposed with several protuberances 62. When the end of the bottom cap 70 is fitted into the cavity 61 of the rotary cover 60, the protuberances 62 are engaged in the annular groove 74 of the bottom cap 70, permitting the rotary cover 60 to be rotated. When requiring illumination, the rotary cover 60 is extracted from the bottom cap 70 for switching the switch on the bottom cap 70. In use, the rotary cover 60 is mated with the bottom cap 70 so as to prevent the switch from being unintentionally touched.

Figure 6:
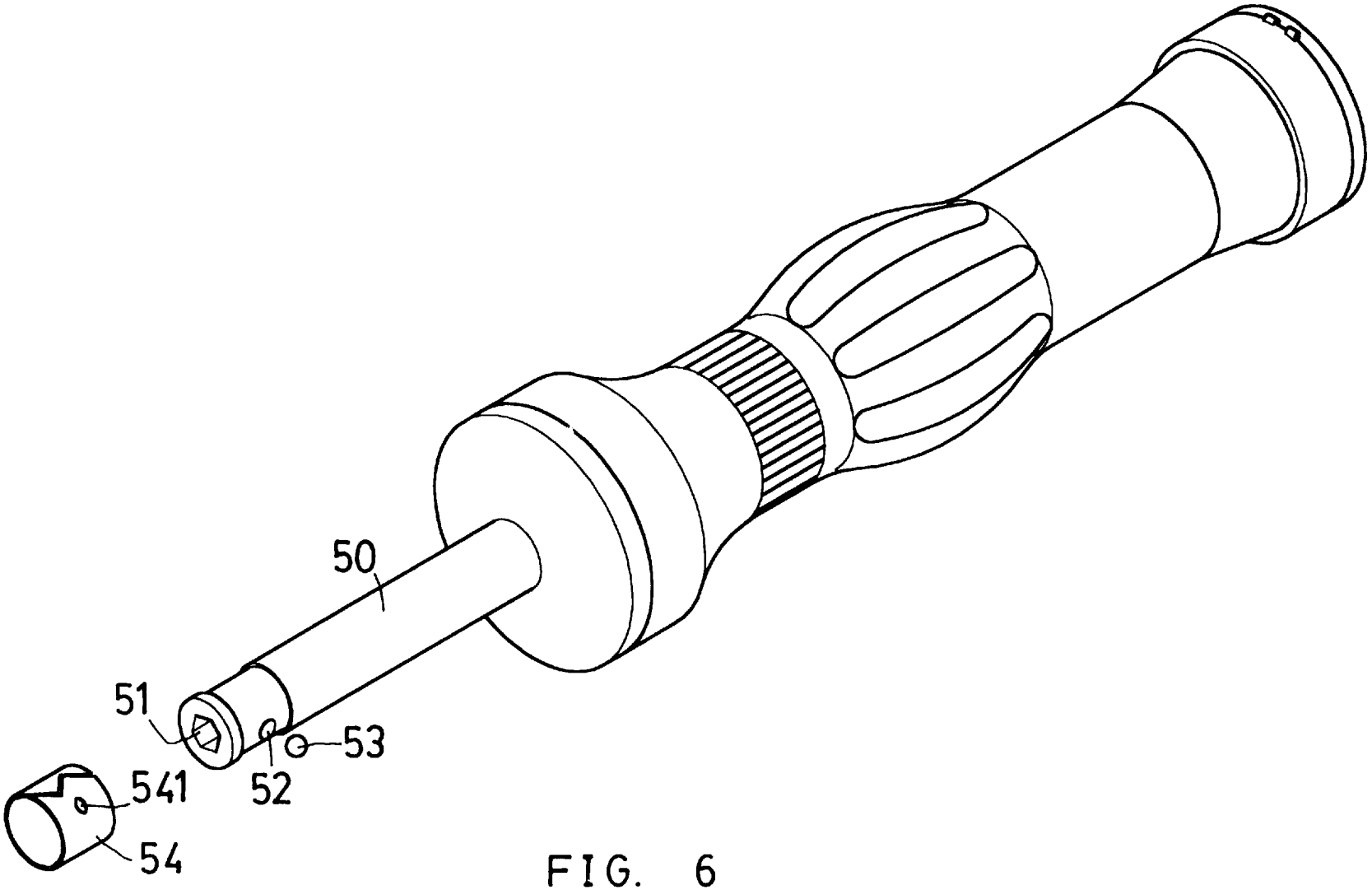
FIG. 6 is a perspective exploded view of a third embodiment of the present invention.
Figure 7:
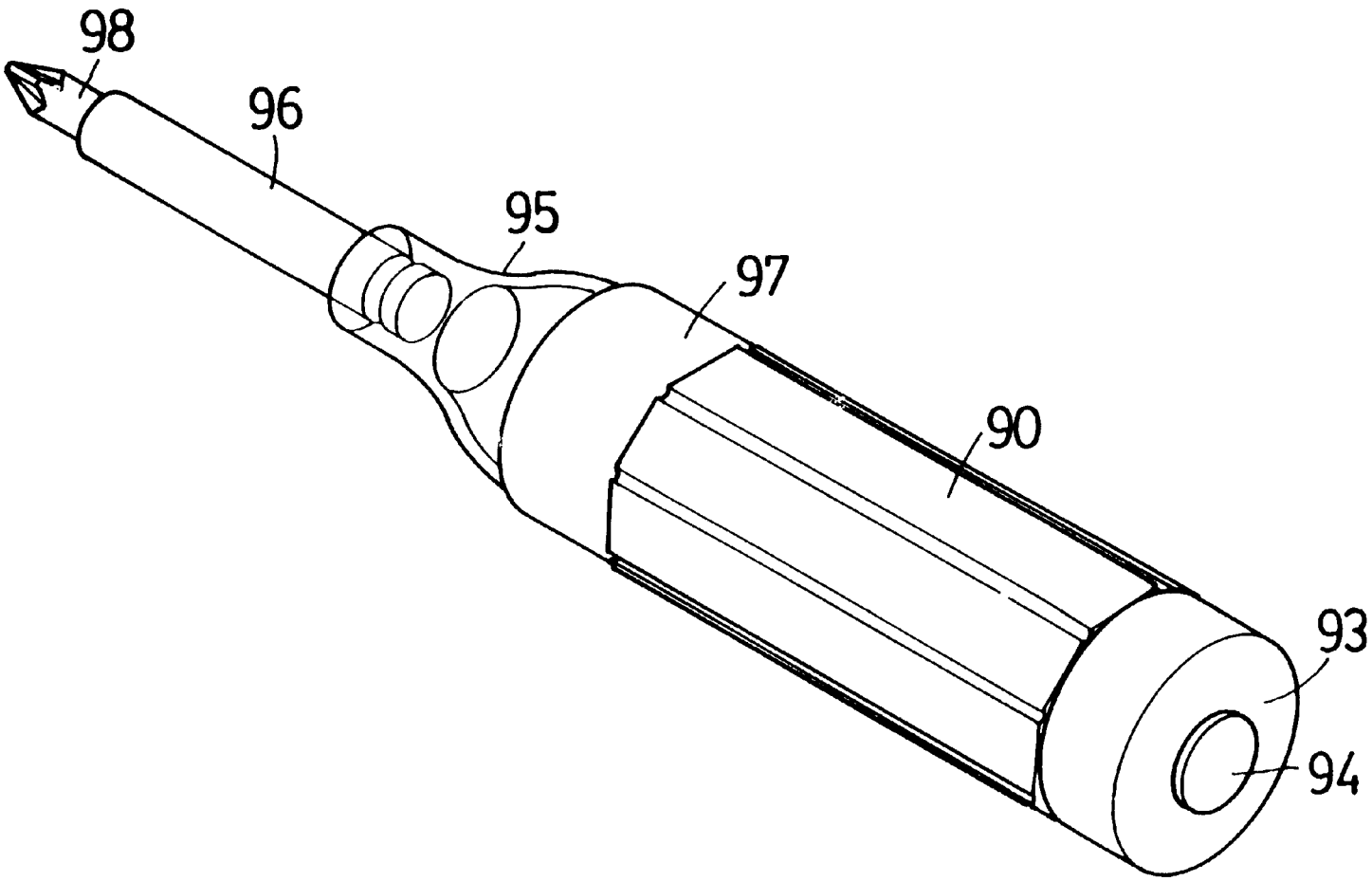
PRIOR ART FIG. 7
FIGS. 7 and 8 show an existing screwdriver.
Figure 8:
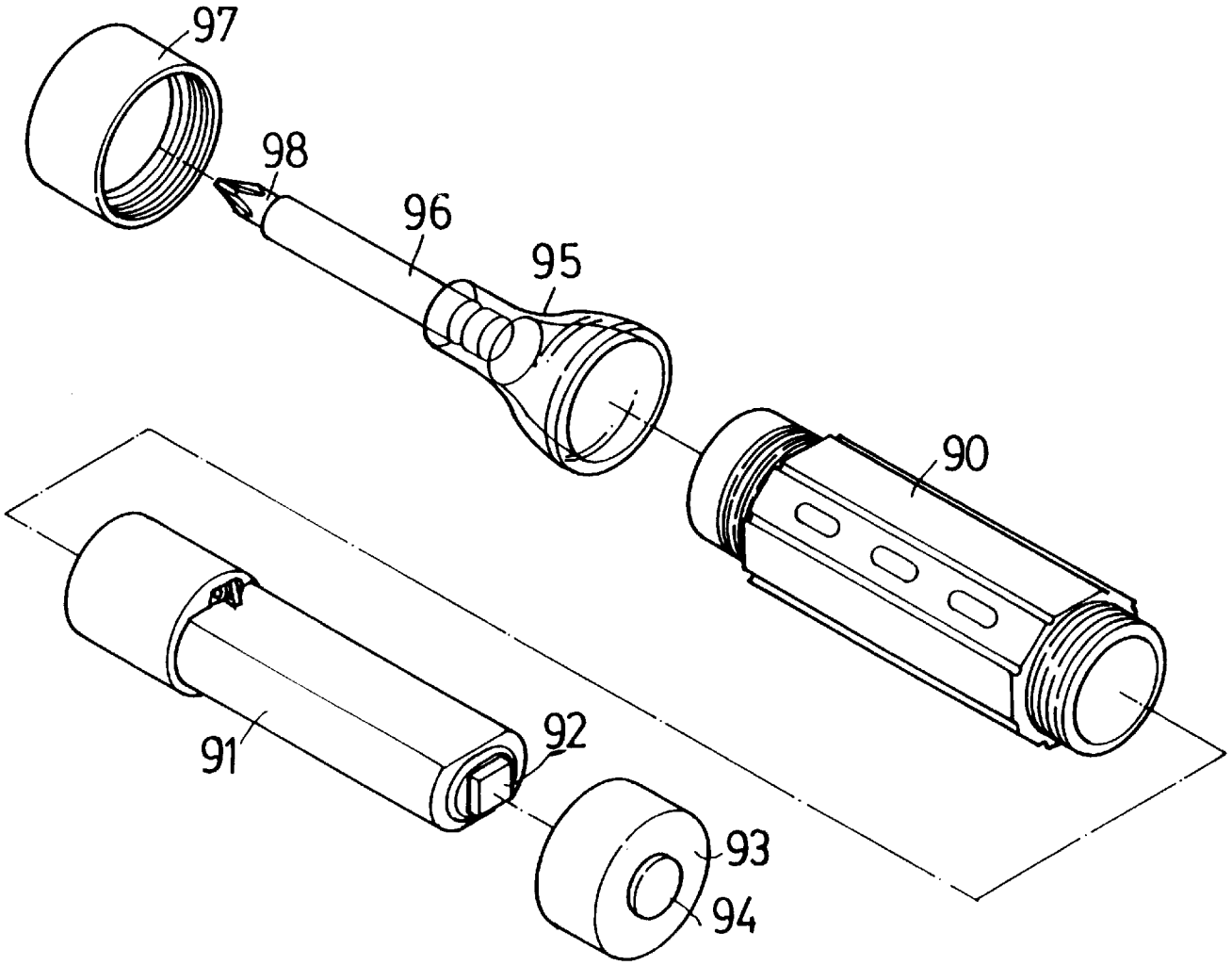
PRIOR ART FIG. 8

FIG. 6 shows a third embodiment of the present invention, in which an outer circumference of the hexagonal socket 51 of the sleeve 50 is formed with a radial semispherical hole 52 in which a steel ball 53 is located. A resilient hoop 54 having a fixing hole 541 is fitted around the sleeve 50, whereby the steel ball 53 is fixed in the hole 52 and the fixing hole 541 and a screwdriver head can be engaged in the hexagonal socket 51.

The above embodiments are only used to illustrate the present invention, not intended to limit the scope thereof. Many modifications of the above embodiments can be made without departing from the spirit of the present invention.

What is claimed is:

1. A precision screwdriver comprising:

a hollow grip, one end of the grip being formed with an outer thread, the other end of the grip being formed with a non-circular socket, a cell being placed in the grip;

a bottom cap an end face of which is disposed with a central switch and a conducting member, the bottom cap being formed with an inner thread for screwing with the outer thread of the grip, a rotary cover being rotatably disposed at the end of the bottom cap;

a light shade in which a bulb is installed, the light shade being fitted into the non-circular socket of the grip; and a sleeve one end of which has a radially extending engaging seat which has an axially extending non-circular section for fitting into the non-circular socket of the grip and connected therewith, an end face of the non-circular section abutting against an end face of the light shade, the other end of the sleeve being formed with a tool connecting section.

2. A precision screwdriver as claimed in claim 1, wherein an outer circumference of the bottom cap is formed with an annular groove in which a flange of a rotary cover is rotatably engaged, an end face of the rotary cover being formed with a central through hole in which the switch is received, one side of the rotary cover being connected with a tail cover via a connecting section, an outer circumference of the rotary cover being formed with a projection radially opposite to the connecting section, the tail cover being formed with an engaging hook corresponding to the projection, whereby the engaging hook can be engaged with the projection so as to latch the tail cover with the rotary cover.

3. A precision screwdriver as claimed in claim 1, wherein an circumference of the bottom cap is formed with an annular groove and the rotary cover has a cavity, a peripheral wall of the cavity being disposed with several protuberances, whereby when the end of the bottom cap is fitted into the cavity of the rotary cover, the switch is received in the cavity and the protuberances are engaged in the annular groove of the bottom cap, permitting the rotary cover to be rotated.

4. A precision screwdriver as claimed in claim 1, wherein the outer circumference of the grip is formed with multiple slipproof channels.

5. A precision screwdriver as claimed in claim 1, wherein the tool connecting section of the sleeve is formed with an axially extending hexagonal socket, an outer circumference of the hexagonal socket being formed with a radial semispherical hole in which a steel ball is located, a resilient hoop having a fixing hole is fitted around the sleeve to fix the steel ball in the semispherical hole and the fixing hole.

6. A precision screwdriver as claimed in claim 1, wherein the tool connecting section of the sleeve is formed with an axially extending hexagonal socket and a magnet is disposed at the bottom of the hexagonal socket.

7. A precision screwdriver as claimed in claim 1, wherein the non-circular socket of the grip is a hexagonal socket and the non-circular section of the engaging seat of the sleeve is a hexagonal section.

8. A precision screwdriver as claimed in claim 1, wherein the sleeve is made of a transparent plastic material.

* * * * *